United States Patent [19]

Ebner

[11] 4,160,586

[45] Jul. 10, 1979

[54] BACKLASHLESS PHOTOTYPESETTER CARRIAGE BRAKE

[75] Inventor: Peter R. Ebner, South Nashua, N.H.

[73] Assignee: Itek Corporation, Lexington, Mass.

[21] Appl. No.: 864,308

[22] Filed: Dec. 27, 1977

[51] Int. Cl.[2] ..... B41B 13/00

[52] U.S. Cl. ..... 354/5; 188/67; 188/83; 188/166; 248/298; 354/13; 355/55

[58] Field of Search ..... 188/67, 83, 166, 41, 188/42; 248/124, 298; 354/5, 14; 355/55; 108/148

[56] References Cited

U.S. PATENT DOCUMENTS

| | | | |
|---|---|---|---|
| 2,764,265 | 9/1956 | Runner | 188/83 X |
| 2,988,177 | 6/1961 | Conrad | 188/83 |
| 3,155,334 | 11/1964 | Loewe | 188/166 X |
| 3,187,829 | 6/1965 | Ulinski | 188/166 X |
| 3,275,109 | 9/1966 | Ganley | 188/83 X |
| 3,347,140 | 10/1967 | Ritchie | 354/14 |
| 3,787,137 | 1/1974 | Renner | 188/67 X |

*Primary Examiner*—George E. A. Halvosa
*Attorney, Agent, or Firm*—Homer O. Blair; Robert L. Nathans

[57] ABSTRACT

A brake mounted upon a moveable phototypesetter lens carriage is in continuous braking contact with a stationary flat elongated way member positioned along the path of motion of the carriage. A central portion of a brake shoe member is rigidly affixed to the moveable carriage and has first and second flexible arm members spring biased against the way member, and the entire brake shoe member consists of a single homogeneous mass of material.

4 Claims, 3 Drawing Figures

BACKLASHLESS PHOTOTYPESETTER CARRIAGE BRAKE

BACKGROUND OF THE INVENTION

Certain phototypesetters employ lenses which are moveable with respect to each other along the optical axis in order to focus and change the size of the images projected upon the photosensitive material. It is desirable to step or drive the moveable carriage in tiny incriments of 1000th of an inch (1 mil) to provide for requisite high degree of accurate lens positioning. After the carriage driving impulse force is removed from the lens carriage, it is necessary to promptly stop the carriage by abruptly overcoming its inertia and maintain the new position. Such action is accomplished by providing a carriage mounted "always on" brake which, regardless of the direction of motion of the carriage, will at all times assert a frictional force upon the moving carriage in opposition to its direction of motion. It was ascertained that a back lash, of 2/1000th of an inch or more was present in commercially available brake designs at the time the invention was made. This back lash of as little as 2/1000th of an inch would reduce the desire sharpness of the projected image or render the image somewhat out of focus.

Bilaterally operating brakes to oppose the inertia of moving members are known in the art. For example, U.S. Pat. No. 2,988,177 issuing June 13, 1961, discloses a spring loaded brake member mounted upon a moveable device which presses against a stationary member to produce forces in opposition to the motion of the moveable member. In FIG. 1 of this patent, central portions of a rigid brake shoe are spring loaded by springs 31 and 32. However, the design inherently requires clearance between the extreme outer portions 33 of the brake shoe and the moving carriage device so that considerable back lash or lost motion would be present, since the springs would be somewhat bent or tipped upon actuation of the brake in a direction transverse their longitudinal axis.

It is thus highly desirable to provide a bi-directional brake of simple design which has virtually no back lash and which provides a constant braking force in either direction, which does not have a tendency to bind, and which is self-adjusting to compensate for wear in order to maintain the requisite bi-directional braking force over the life of the brake.

SUMMARY OF THE INVENTION

In accordance with a preferred embodiment of the invention, a brake shoe member consisting of a single homogeneous mass of suitable brake shoe material has a central portion rigidly affixed to the moveable carriage and has first and second flexible arm members having outer portions individually spring biased against the way member to accomplish the above-stated objects of the invention.

Other objects, features, and advantages of the present invention will become apparent upon the perusal of the following description taken in conjunction with the drawings in which.

DETAILED DESCRIPTION

Figure 1:
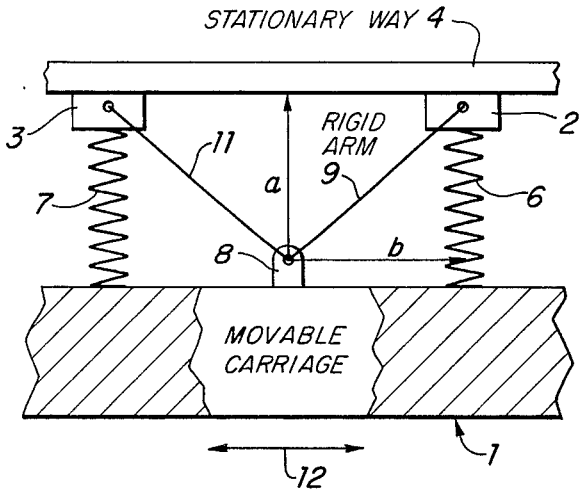
FIG. 1. PRIOR ART
FIG. 1 illustrates a first design approach.

In referring to FIG. 1, a moveable carriage 1 is provided having brake shoe members 2 and 3 spring biased against stationary way member 4 by springs 6 and 7. Brake shoe 2 is connected to a central carriage portion 8 by a rigid arm 9 while brake shoe 3 is connected to central portion 8 by rigid arm 11. Bilateral motion of carriage 1, illustrated by arrow 12, will produce the above-mentioned bilateral braking forces in opposition to the inertia of carriage 1. One problem with this arrangement is that there is a tendency for the brake shoes to self-energize and thus modify the friction force as a function of direction. This self-energizing effect is due to the brake pad friction force causing a moment about the pivot at 8, which is countered by a moment which results in an increase or decrease in normal force at the brake pad. This self-energizing effect can be minimized by reducing the ratio of a/b as seen in FIG. 1. The diameter of the pivot bearings and the thickness of the brake pad material in this design limits how much a/b can be reduced. In fact, when the ratio of a/b is greater than the coefficient of friction, binding will occur and the brake will "lock-up". When two brakes are used together as in FIGS. 1, 2 & 3, the increases and decreases in brake force due to directional changes net the same amount regardless of direction. Furthermore, the pivot points at both extremities of arms 9 and 11 and at 8 are subject to wear over the life of the brake, which in turn, produces the lost motion or undesirable back lash discussed hereinabove.

Figure 2:
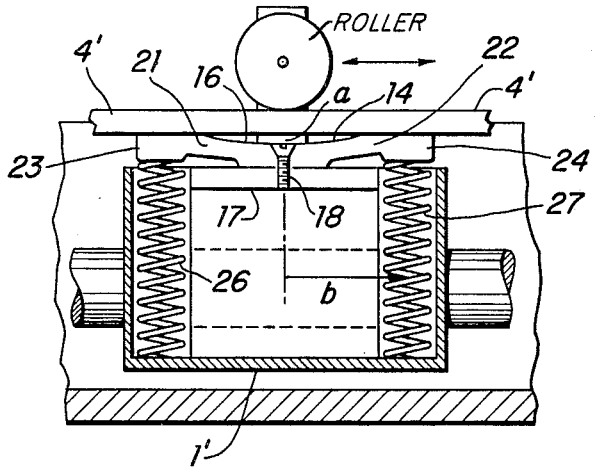
FIGS. 2 and 3 illustrate preferred embodiments of the invention.
Figure 3:
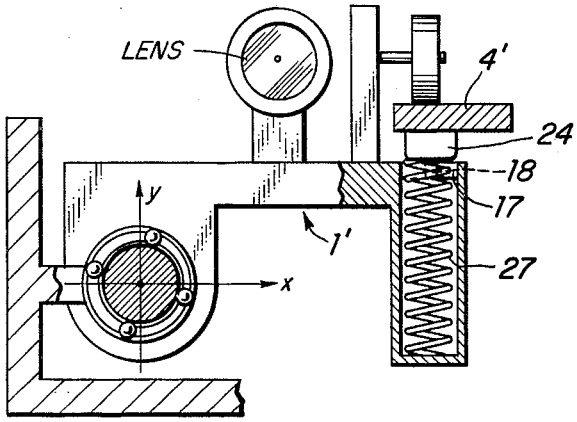

In accordance with the preferred embodiment of the present invention, a unitary flexible brake shoe 14, illustrated in FIG. 2, is provided, having a central portion 16 rigidly affixed to carriage portion 17 by a fastener, such as screw 18. In contrast with the rigid links of FIG. 1, flexible arm portions 21 and 22, having outer portions 23 and 24, are provided. Vertical spring 26 urges outer shoe portion 23 against the underside of way member 4', while outer portion 24 is urged against way member 4' by spring 27. The remaining elements illustrated from no part of the present invention and references may be made to copending application No. 790,713, filed Apr. 25, 1977 now U.S. Pat. No. 4,119,976, and assigned to the same assignee as the present invention, with respect to their functions.

The wearing of the terminal brake shoe portions 23 and 24 is readily compensated for by means of springs 26 and 27 and the bilateral braking force will be maintained constant during the life of the brake. Owing to this design, the elimination of pivotably-mounted brake shoe members eliminates the possibility of lost motion or back lash over the life of the brake and furthermore, a tendency to self-energize or bind is greatly reduced because in effect, the pivot point (analogous to point 8 of FIG. 1) has been moved closer to the stationary way member and thus, the ratio of a/b has been minimized by providing a shallow concaved brake shoe configuration.

In the preferred embodiment of the invention, the following design perimeters were employed:

The overall length of the brake shoe extending between extremities 23 and 24 was 2¾ inches.

The homogeneous body of the brake shoe consisted of DuPont "Delrin" plastic.

The spring constant of extremities of the shoe in a direction along the longitudinal axis of the helical coil springs was 16 lbs. per inch and a deflection of 1/16" in the operating position produces a 1 lb. force acting against the spring.

The spring constant of the helical coil springs 26 and 27 along the longitudinal axis was 16 lbs. per inch; a deflection of ½ inch producing a resulting force of 8 lbs.

The coefficient of friction between shoe portions 23 and 24 and way member 4' was 0.3.

While preferred embodiments have been described, others may be readily envisioned by the worker in the art within the scope of the following claims.

The term "shallow configuration" set forth in the claims means that the above-mentioned ratio of a/b is less than 1/10 and the ratio was about 1/16 for the commerical embodiment. This ratio must, in any event, be less than the above-mentioned coefficient of friction and is preferably as small as possible. In FIG. 2, the a dimension extends from the top of the screw to the bottom of way member 4' and the b dimension extends from the longitudinal axis of the screw to the longitudinal axis of the helical spring 16.

What is claimed is:

1. In a phototypesetter having a movable lens carriage, a backlashless carriage brake for applying a constant force in opposition to the bilateral motion of said carriage comprising:

a. an elongated way member positioned along the path of motion of said carriage;

b. a brake shoe member having a central portion rigidly affixed to said movable carriage and having a first bowed flexible arm member having an outer portion thereof together with a second bowed flexible arm member having an outer portion thereof;

c. first spring means separate from said flexible arm member for urging the outer portion of said first flexible arm member against said way member;

d. second spring means separate from said flexible arm member for urging the outer portion of said second flexible arm member against said way member; and e. said brake shoe member having a shallow configuration, i.e., the ratio of the perpendicular distance from said rigidly fixed central portion to the elongated way to the perpendicular distance from said rigidly fixed central portion to the respective spring means is less than 1/10.

2. The combination as set forth in claim 1 wherein said brake shoe member has a concaved configuration with respect to said elongated way member.

3. The combination as set forth in claim 2 wherein said brake shoe member consists of a unitary body of braking material.

4. The combination as set forth in claim 1 wherein said brake shoe member consists of a unitary body of braking material.

* * * * *